United States Patent [19]

Aviram et al.

[11] Patent Number: 4,491,431

[45] Date of Patent: Jan. 1, 1985

[54] METAL-INSULATOR RESISTIVE RIBBON FOR THERMAL TRANSFER PRINTING

[75] Inventors: Ari Aviram; Kwang K. Shih, both of Yorktown Heights, N.Y.

[73] Assignee: International Business Machines Corporation, Armonk, N.Y.

[21] Appl. No.: 454,812

[22] Filed: Dec. 30, 1982

[51] Int. Cl.[3] ..... B41J 31/02

[52] U.S. Cl. ..... 400/241.1; 400/120; 428/913; 428/914

[58] Field of Search ..... 400/118, 119, 120, 241, 400/241.1; 346/76 R, 76 L; 428/913, 914; 204/181 C

[56] References Cited

U.S. PATENT DOCUMENTS

| | | | |
|---|---|---|---|
| 3,744,611 | 7/1973 | Montanari et al. | 400/120 |
| 4,268,368 | 5/1981 | Aviram et al. | 204/181 C |
| 4,309,117 | 1/1982 | Chang et al. | 400/241.1 |

OTHER PUBLICATIONS

IBM Technical Disclosure Bulletin, "Electrothermic Printing Method and Apparatus Using a Photoconductor and Fusible Ink," Aviram, vol. 20, No. 2, Jul. 1977, pp. 808–809.

IBM Technical Disclosure Bulletin, "Thermal Building Technique for Electrothermic Printing," Wilbur, vol. 23, No. 9, Feb. 1981, p. 4302.

IBM Technical Disclosure Bulletin, "Electrothermal Print Head," Wilbur, vol. 23, No. 9, Feb. 1981, pp. 4305–4306.

IBM Technical Disclosure Bulletin, "Inorganic Resistive Layer for Electrothermal Printing," Chang, vol. 24, No. 11B, Apr. 1982, p. 6195.

IBM Technical Disclosure Bulletin, "Amorphous Film Printing Using DC Power and Pulse Selection," Aviram et al., vol. 25, No. 5, Oct. 1982, pp. 2602–2603.

*Primary Examiner*—Ernest T. Wright, Jr.

*Attorney, Agent, or Firm*—Jackson E. Stanland

[57] ABSTRACT

A resistive ribbon printing technique is described in which the ribbon includes a resistive layer comprised of a metal-wide bandgap insulator combination. The ribbon also includes a support layer, where the support function can be provided by the resistive layer, and a fusible ink layer. Electrical current through the resistive layer produces heat which locally melts the ink for transfer to an adjacent receiving medium. The wide bandgap insulator of the resistive layer must have a bandgap of at least three volts. Many different metals and insulators can be used, where the relative amounts of metal and insulator are chosen to provide a desired resistivity for any type of resistive ribbon printing application.

24 Claims, 9 Drawing Figures

METAL-INSULATOR RESISTIVE RIBBON FOR THERMAL TRANSFER PRINTING

DESCRIPTION

1. Technical Field

This invention relates to resistive ribbon thermal transfer printing and more particularly to an improved ribbon for that use, the improved ribbon being comprised of a multi component composition (such as a cermet) including a metal and a wide bandgap insulator.

2. Background Art

Thermal transfer printing is a type of non-impact printing that is becoming increasingly popular as a technique for producing high quality printed materials. Applications for this type of printing exist in low volume printing such as that used in computer terminals and typewriters. In thermal transfer printing, ink is printed on the face of a receiving material (such as paper) whenever a fusible ink layer is brought into contact with the receiving surface, and is softened by a source of thermal energy. The thermal energy causes the ink to locally melt and transfer to the receiving surface.

In one type of thermal transfer printing, termed resistive ribbon thermal transfer, a thin ribbon is used including a support layer, a layer of fusible ink that is brought into contact with the receiving medium, and a layer of electrically resistive material. In a variation, the resistive layer is thick enough to be the support layer, so that a separate support layer is not needed. A thin electrically conductive layer is also optionally provided. In order to transfer ink from the fusible ink layer to the receiving medium, the layer of ink is brought into contact with the receiving surface. The ribbon is also contacted by an electrical power supply and selectively contacted by a thin printing stylus at those points opposite the receiving surface where it is desired to print. When current is applied to the thin printing stylus, it travels through the resistive layer and causes local resistive heating which melts a small volume of ink in the fusible ink layer. This melted ink is then transferred to the receiving medium to effect printing. Resistive ribbon thermal transfer printing is described in U.S. Pat. No. 3,744,611, and also in IBM Technical Disclosure Bulletin, Vol. 23, No. 9, February 1981, at page 4305.

In resistive ribbon thermal transfer printing, it is often the situation that the substrate contact to the printing head becomes unduly heated and debris accumulates on the printhead. This increases contact resistance and develops heat in the printhead. To overcome the accumulation of debris and the increase in contact resistance, the amplitude of the applied current has to be increased. This is disadvantageous, however, because it can produce adverse fumes and ruin the substrate (support layer).

A technique for reducing the amount of power required to be supplied by the printhead in a resistive ribbon thermal transfer process is described in IBM Technical Disclosure Bulletin, Vol. 23, No. 9, February 1981, at page 4302. In this approach, a bias current is provided through a roller into the resistive layer located in the printing ribbon. The bias current produces some heating and leads to the result that not all of the energy required to melt the ink has to be supplied through the printhead.

Another approach which possibly provides some amplification of heat is that described in IBM Technical Disclosure Bulletin, Vol. 20, No. 2, July 1977, at page 808. In this reference, a photoconductive layer is located between two electrodes, across which is attached a power supply. When light strikes the photoconductor, it will become conductive in the region where it is hit by the light, and will close the circuit between the two electrodes. This provides a current flow where the current is a source of heat that develops in the conductor and is transferred to an adjacent ink layer. The ink layer is locally melted so that ink can be transferred to the receiving medium.

Copending U.S. patent application Ser. No. 356,657, filed March 10, 1982 in the names of Aviram and Shih, now U.S. Pat. No. 4,470,714 issued Sept. 11, 1984 and assigned to the same assignee as the present application, describes an improved resistive ribbon for use in thermal transfer printing. As noted in this copending application, prior art attempts to provide resistive ribbons for thermal transfer printing typically encountered significant limitations. For example, the material selected to support both the fusible ink layer and the resistive layer has been difficult to adhere to other layers of the ribbon. Another problem arises because the same supporting layer may act as a thermal barrier to the transfer of heat from the resistive layer to the ink layer, thereby impeding the printing process. Additionally, the resistive layers of prior art ribbons have typically been comprised of graphite dispersed in a binder. Since these resistive layers require a great deal of energy for heating, it was sometimes the situation that the resistive layer might be burned through before printing occurred, with the release of adverse fumes.

In order to overcome these obstacles, the resistive ribbon of aforementioned copending application Ser. No. 356,657 proposed the use of an inorganic resistive layer preferrably comprised of a binary alloy. One example of such a resistive layer was a metal silicide layer. Particularly preferred metal silicides included the non-stoichiometric metal silicides $M_{1-x}Si_x$. These resistive materials were used to induce resistive heating at very low energy inputs and to avoid the need for a polymeric binder in the resistive layer. This eliminated the burn-through problem described previously and also avoided the toxic fumes problem which occurs when polymeric binders are used.

Although the resistive layers of aforementioned copending application Ser. No. 356,657 provide particular advantages, one characteristic exhibited by some of those layers could be a bit troublesome in actual printing applications. This characteristic is a switching behavior in which the impedance level of the resistive layer changes at a certain voltage. At initial non-printing voltages, these binary alloys exhibit high impedance. However, when a certain voltage is reached, the resistive material switches to a low impedance state. As a result, a "holding" voltage (i.e., the voltage associated with the low impedance state) is obtained and the current through the resistive layer sharply increases. The holding voltage in those binary alloys is typically about 1.5 volts. The presence of this switching behavior means that constant current power sources can be used only with difficulty and constant voltage power sources are preferred.

Since resistive layers commonly require a certain level of power in order to induce sufficient resistive heating to adequately melt the fusible ink layer, it is preferrable that the voltage of the low impedance state (in which printing occurs) be as high as possible. For a constant power, this means that the amount of current can be brought into the range available from the power supply. In the practice of the present invention, this problem has been solved by using resistive layer compositions which, if switching to a low impedance state occurs, will exhibit higher holding voltages. In turn, this will minimize the magnitude of the required current. Both constant current sources and constant voltage sources can be successfully employed when these new resistive layers are used.

Accordingly, it is a primary object of the present invention to provide an improved ribbon for resistive ribbon thermal transfer printing, where the improved ribbon includes a resistive layer whose impedance switching behavior, if any, possesses a high holding voltage during printing.

It is another object of the present invention to provide an improved ribbon for use in resistive ribbon thermal transfer printing which is easy to fabricate in layers of uniform thickness.

It is another object of this invention to provide an improved resistive ribbon for thermal transfer printing in which the resistive layer can be thin without adding increased bulk to the ribbon.

It is a further object of this invention to provide a resistive ribbon for thermal transfer printing in which the resistive layer is compatible with other layers in the ribbon and can be easily fabricated thereon.

It is a further object of this invention to provide an improved resistive ribbon for thermal transfer printing in which the resistance of a resistive layer thereon can be tailored in accordance with the composition chosen for the resistive layer.

It is a still further object of the present invention to provide a resistive ribbon for use in thermal transfer printing in which problems of burn-through and adverse fumes are minimized.

It is a still further object of the present invention to provide a resistive ribbon for thermal transfer printing in which the resistive layer is comprised of a minimum number of components, thereby making its fabrication simpler.

It is another object of the present invention to provide a resistive ribbon for thermal transfer printing wherein the resistive layer of the ribbon can be made with a uniform composition and resistance through the length of the ribbon.

It is a further object of this invention to provide a resistive ribbon for thermal transfer printing, which results in economical, efficient, and high quality printing.

It is another object of this invention to provide a resistive ribbon for thermal transfer printing in which the resistive layer of the ribbon can be manufactured by a number of processes, none of which requires the use of toxic materials.

DISCLOSURE OF THE INVENTION

The resistive ribbon (or any other structure for supporting a layer of ink) of this invention includes at least a support layer, a fusible ink layer, and a resistive layer. Electrical current through the resistive layer produces heat that locally melts the ink for transfer to an adjacent medium. In a variation, the support function is provided by the resistive layer, which is thick, so that a separate support layer is not needed. One type of ribbon includes an additional highly electrically conductive layer through which the printing current passes along its return path, although such a layer is optional.

The resistive layer is comprised of a multi-component composition including a metal (such as Ti, Ni, Cr, Mo, W, Co, and Sn) and a wide bandgap insulator (such as $Al_2O_3$, $SiO_2$, $SnO_2$, and AlN), where the relative amounts of metal and insulator are chosen to provide a desired restivity. The bandgap of the insulator is at least three volts. The structure of the resistive layer is not important, and can be amorphous, microcrystalline, crystalline, a cermet, etc. The thickness of the resistive layer may vary depending upon its environment, a preferred range being from about 0.5–2 micrometers. The resistive layers are typically about 1 micrometer thick.

These and other objects, features, and advantages will be apparent from the following more particular description of the preferred embodiments.

BEST MODE FOR CARRYING OUT THE INVENTION

Figure 1:
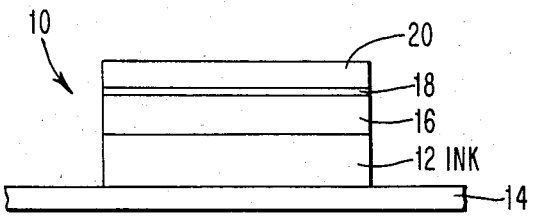
FIG. 1 shows the four-layered embodiment of a resistive ribbon according to the present invention.

This invention pertains to an improved ribbon or other type of structure used in resistive transfer printing, wherein current through a resistive layer produces heat to melt and transfer ink from the ribbon or structure to an adjacent receiving medium, such as paper. The resistive layer is comprised of a composition including a metal and a wide bandgap insulator, where the bandgap of the insulator is greater than three volts. By using wide bandgap insulators, the voltage across the resistive layer in its low impedance switching state (if switching occurs) is greater than two volts in order to provide a high voltage, low current printing operation.

Many different wide-band insulators can be used, and the metal is present to provide some conductivity to the composition. The lattice structure and the precise chemical composition of the mixture in the resistive layer are unimportant, as long as it has the desired resistivity, thickness uniformity, and compositional uniformity. In the practice of this invention, it has been found that many metal-wide bandgap insulator combinations can be used to provide these characteristics. Of course, the preferred range of resistivity depends upon the power supply which will be used in the printing system. For example, for a system in which the power supply provides square wave pulses up to 30 volts having widths 200 microseconds-1 millisecond, and 30 mA, a desired resistivity range of 100–2000 ohms/sq. is suitable. For this particular system, the resistive layer is 1000 Å-two microns thick. Of course, if printing at higher power levels can be tolerated, the restivity of the metal-insulator mixture can be greater, as can be its thickness. The following lists several suitable insulator materials, and their bandgap energies in electron volts (eV).

| Insulator (Bandgap energy eV) | |
|---|---|
| $Al_2O_3$ (approx. 8) | $SiO_2$ (approx. 10) |
| $TiO_2$ (approx. 4) | MgO (approx. 5) |
| SiO (approx. 8) | $Ta_2O_5$ (4–4.5) |
| AlN (approx. 3–4) | $SnO_2$ (approx. 3–4) |
| $Ge_3N_4$ (approx. 3–4) | $In_2O_3$ (approx. 3–4) |
| $Nb_2O_5$ (approx. 4) | |

Various metals can be mixed with these insulators to provide a usable system. Such metals include Ti, Ni, Cr, Mo, W, Co, Sn, Al, Au, Cu, etc. It is often best to use only one metal in the metal-insulator composition, as for instance Al with $Al_2O_3$; Sn with $SnO_2$; Ti with $TiO_2$, etc. Since the atomic structure of these resistive layers can range from amorphous to crystalline without affecting the invention, various combinations of metal-wide bandgap insulators can be used. However, as pointed out, it is often simpler to use only one metal in the composition for reasons such as ease of fabrication.

Although the drawing will illustrate different compositional ranges of the metal-insulator resistive layer, the following list will provide some representative compositions which can be used in resistive ribbons.

| Insulator (Bandgap energy eV) | |
|---|---|
| $Ti_{.045}(Al_2O_3)_{0.55}$ | $Al_{0.5}(Al_2O_3)_{0.5}$ |
| $Ti_{0.5}(Al_2O_3)_{0.50}$ | $Al_{0.57}(Al_2O_3)_{0.43}$ |
| $Ni_{0.45}(Al_2O_3)_{0.55}$ | $Ti_{0.5}(SiO_2)_{0.5}$ |
| $Ti_{0.3}(TiO_2)_{0.7}$ | $Ti_{0.4}(SiO)_{0.6}$ |
| $Ti_{0.3}(TiO)_{0.7}$ | $Ni_{0.5}(SiO_2)_{0.5}$ |
| $Ti_{0.35}(MgO)_{0.65}$ | $S_n^x(S_nO_2)_{1-x}$ |
| | $0.5 \leqq x \leqq 0.6$ |

Deposition of Resistive Layer

The resistive layers of this invention can be fabricated in many ways, including evaporation and sputtering. For example, dual electron beam evaporation can be used in which one of the electron beams is used to evaporate a metal source (such as Al) while a second electron beam is used to evaporate a wide bandgap insulator source (such as $Al_2O_3$) The Al atoms, oxygen atoms, and $Al_2O_3$ molecules then drift to the substrate where they deposit and form an Al-$Al_2O_3$ mixture.

In addition to electron beam evaporation, the sources can be heated by techniques such as resistive heating. Both electron beam evaporation and resistive heating evaporation are well known techniques, and are generally implemented in a vacuum chamber.

Another variation which can be used to fabricate the metal-wide bandgap insulator composition is evaporation in the presence of a gaseous atmosphere. In this technique, a single source (metal) can be used. This works particularly well when the metal is the same as the metal in the insulator (for example, Al-$Al_2O_3$). If an Al source is heated resistivly or by an electron beam in the presence of an oxygen atmosphere, some free Al and oxygen ions and atoms will deposit on the substrate, as will molecules of $Al_2O_3$. A composition of Al-$Al_2O_3$ will be formed. Another example of this type of evaporation is Al-AlN compositions. Here the metal source would be Al, and the gaseous environment in the vacuum chamber would be nitrogen. Free atoms of Al and nitrogen, and molecules of AlN would deposit on the ribbon substrate.

Another technique for fabricating the resistive layer is sputtering. Both dc and rf sputtering can be used. In a first technique, co-sputtering is used, in which two sources (targets) are placed in the vacuum chamber. One target is the metal and the other is the wide bandgap insulator. Dual sputtering ion beams are provided, one of which strikes the metal target while the other strikes the wide bandgap insulator target. A suitable sputtering ion is argon. Metal atoms then travel to the ribbon substrate, as do gas atoms and molecules of the insulator. In the sputtering process, some metal atoms and gas atoms from the insulator may travel to the ribbon substrate and combine on the substrate. For example, if the insulator target is $Al_2O_3$, it is possible to sputter $Al_2O_3$ molecules therefrom, as well as atoms of Al and oxygen.

As an alternative to the dual target sputtering system, a single target can be used in which the metal and insulator are mixed in powdered form in the proportions which are desired in the resistive layer. For example, powders of Al and $Al_2O_3$ can be premixed in appropriate proportions of Al and $Al_2O_3$. This target can be sputtered onto the ribbon to provide the resistive layer, where the proportions of metal and wide bandgap insulator present in the target will be reproduced on the ribbon.

Another alternative to the sputtering technique is one in which the metal is sputtered in the presence of the gaseous atmosphere. This is similar to the evaporation process described wherein a single metal source is used. In the present situation using sputtering, the gaseous environment provides the insulator portion of the metal-insulator resistive layer. For example, Al can be sputtered in an oxygen atmosphere. This will produce atoms of Al and atoms of oxygen, as well as molecules of $Al_2O_3$. Some of the free Al will combine with oxygen at the ribbon substrate to produce $Al_2O_3$. The final composition will be a mixture of $Al\text{-}Al_2O_3$.

As was mentioned previously, the exact lattice structure and chemical composition of the resistive layer are not important. The technique of this invention is to provide metal-wide bandgap insulator mixtures in which the proportions of metal and insulator are adjusted to give the required resistivity in a suitable thickness range depending upon the printing application. X-ray diffraction analysis has been used to examine many of the resistive layers which have been fabricated. In this analysis, no scattering from any type of periodic structure was found, and consequently those resistive layers which have been examined have been amorphous in character, with quite homogeneous compositions and uniform thicknesses. Microcrystalline structure can be tolerated, as well as cermet compositions. Because many amorphous mixtures can readily be made using metal-wide bandgap insulator compositions, the particular composition can be easily tailored to a particular application, without worrying about factors such as stoichiometric ratios. This contrasts with crystalline materials where a particular composition is imposed. This means that ease of fabrication will result and the compositional ranges of the materials can be tailored to a particular purpose.

As a further example of the different types of methods which can be used to fabricate these resistive layers, the following list of materials is presented, showing appropriate fabrication techniques. Of course, it will be understood by one of skill in the art that the same material can be made a variety of ways in order to vary its resistivity. For example, a metal-insulator composition can be made by evaporation in which the rate of evaporation is varied to provide different compositional ranges. Still further, the rate of evaporation can be varied as well as the pressure of the gaseous environment in the vacuum chamber, to provide additional compositions. By varying parameters such as the rate of evaporation and the gaseous pressure, the relative percentages of metal and insulator can be varied.

| | |
|---|---|
| $Cr_x(Cr_2O_3)_{1-x}$ | Cr is evaporated or sputtered in an $O_2$ atmosphere. |
| $Ti_x(TiO_2)_{1-x}$ | Ti is evaporated or sputtered in an oxygen atmosphere. |
| $Sn_x(SnO_2)_{1-x}$ | Sn is evaporated or sputtered in an oxygen atmosphere. |
| $Mg_x(MgO)_{1-x}$ | Mg is evaporated or sputtered in an oxygen atmosphere. |
| $Ta_x(Ta_2O_5)_{1-x}$ | Ta is evaporated or sputtered in an oxygen atmosphere. |
| $In_x(In_2O_3)_{1-x}$ | In is evaporated or sputtered in an oxygen atmosphere. |
| $Al_x(Al_n)_{1-x}$ | Al is evaporated or sputtered in a nitrogen atmosphere. |

(Multi-layered Ribbons-FIGS. 1–4)

FIG. 1 shows a four-layer ribbon 10 having an ink layer 12 which is adjacent to a receiving medium, such as a paper 14. Ribbon 10 also includes a support layer 16, a thin highly conductive layer 18, and a resistive layer 20 which is comprised of the metal-wide bandgap insulator combination of the present invention. When this ribbon is contacted by the stylus and a ground electrode, current will flow through the stylus into the resistive layer 20 and return through the conductive layer 18 to the ground electrode via the resistive layer 20. Most of the heat will be concentrated under the thin stylus, and will melt a volume of ink beneath the stylus. When the viscosity of the ink is sufficiently low, the melted ink will transfer to the paper 14.

In the fabrication of ribbon 10, the individual layers 12, 16, 18 and 20 may be adhered to each other by any well known and convenient means, including methods of thin film deposition and application of binders or other materials having good adhering qualities. The support layer 16 is typically comprised of an electrically non-conductive material which is flexible enough to allow the formation of spools or other "wrapped" packages for storage and shipping. The support layer 16 is capable of supporting the remaining layers 12, 18 and 20 of the ribbon 10. Additionally, it (layer 16) should be formed of a material which does not significantly impede the transfer of thermal energy from the resistive layer 20 on one side of the support layer 16 to the fusible ink layer 12 on the other side, as this increases the efficiency of printing, and means that less energy is required to do the same work. Although many materials may be employed as the support layer 16, as is well known in the art, the preferred material is myler polyester film. Other preferred materials include polyethylene, polysulphones, polypropylene, polycarbonate, polyvinylidene fluoride, polyvinylidene chloride, polyvinyl chloride, and Kapton (a trademark of E. I. Du Pont de Nemours, Inc.).

Although the thicknesses of the support layer 16, and other layers 12, 18 and 20 of the ribbon 10, is controlled to some degree by the required transfer of thermal energy and the ability to store a ribbon 10, as well as by the machinery with which it is used, the support layer is generally about 2.54–5 micrometers in thickness. If the support layer 16 is less than about 0.08 mils in thickness, it will be too fragile while, if the support layer 16 is greater than 0.25 mil, it will create a large thermal barrier and too much power will be required to heat the fusible ink layer 12. The ink layer 12 is typically about 4–6 micrometers in thickness and preferrably about five micrometers. The thin metallic layer 18 is typically comprised of aluminum, with a preferred thickness of 50–200 nm. Generally, 100 nm is suitable. Resistive layer 20 is usually about 1 micrometer thick, a preferred range being from about 0.5 micrometers to 2 micrometers. The ink composition of layer 12 can be any type of ink which is solid at room temperature and which melts and flows at an elevated temperature. Although many fusible ink compositions may be used, a preferred ink composition contains a polyamide and carbon black. One particularly preferred composition is a versamide/-carbon black mixture which melts at approximately 90° C. This ink composition and others are disclosed in U.S. Pat. No. 4,268,368.

Resistive layer 20 is applied to the free surface of the support layer 16 when conductive layer 18 is not used, or to that of the conductive layer 18 in the four layer embodiment of FIG. 1. The resistive layer 20 is comprised of a metal-wide bandgap insulator material, where the bandgap of the insulator is at least three volts. Representative compositions of the resistive layer 20 have been given previously, and will be illustrated more fully in FIGS. 5–9. These resistive materials induce resistive heating at very low energy inputs, thereby overcoming many prior art disadvantages. Also, these resistive materials need not be supported in a polymeric binder, and therefore do not experience burn-through and do not create toxic fumes. Another advantage of this thin package is the ability to pack more ribbon area in a given diameter spool. The metals that are employed in the resistive layer 20 are chosen to provide a suitable resistivity when combined with the wide bandgap insulator and are, in that sense, similar to dopants used to change the conductivity of semiconductors. Also, they are chosen to be metals which will not, when combined in the mixture, explosively, harmfully, or otherwise chemically react upon resistive heating. For example, lead is a metal which should be avoided, because of its tendency to produce toxic fumes. Within these general guidelines, any metal can be chosen. Similarly, any insulator which has a bandgap of at least three volts and meets these other general requirements, can be used. In the printing system described previously where 30 volt square wave pulses were used, a suitable sheet restivity of layer 20 is 100–2000 ohm per sq.

The resistive layer 20 may be applied to the metallic layer 18 to the support layer 16 by any of a number of thin film deposition methods well known in the art. These include vacuum evaporation and sputtering. Generally, in resistive ribbon transfer printing, the power supplies may be set to whatever current is desired to induce the required resistive heating. Although the power supply may be varied to achieve optimum printing, the supply described previously together with this ribbon 10 will yield effective printing at 60 milliwatts or greater, with pulses having widths of 200 microseconds. These pulses are up to 30 volts in amplitude and provide 30 mA. The duty cycle of these pulses is 50%. Of course, other waveforms can be used, including sine waves, sawtooth waves, etc.

Figure 2:
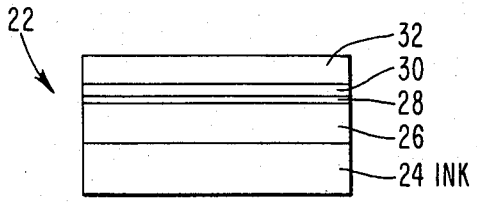
FIG. 2 shows an alternative embodiment of a resistive ribbon in accordance with the present invention, where a thin insulator interface layer (such as sapphire etc) is located between a conductive current return layer and the resistive layer.

In FIG. 2, the ribbon 22 is comprised of an extra layer 30 termed an interface layer. This extra layer 30 is a layer of insulating material such as sapphire or any of the other wide bandgap insulators listed previously, which is located between the thin, highly conductive layer and the resistive layer. Its purpose is to increase the resistance in order to shift the holding voltage for those resistive layers which switch to a lower impedance state. This will be more apparent from FIGS. 7 and 8, where the current-voltage curves for different compositions are shown. At this phase of the discussion, it is sufficient to state that the interface insulating layer is used to provide additional resistance in order to shift the current-voltage characteristic of the interface layer-resistive layer combination.

The ribbon 22 of FIG. 2 is comprised of an ink-bearing layer 24, a support layer 26, a thin highly conductive layer 28, an interface layer 30, and a resistive layer 32. The compositions and thicknesses of resistive layer 32, and of the other layers 24, 26 and 28 in ribbon 22, can be the same as the functionally similar layers of FIG. 1. The thickness of interface layer 30 is typically in the range 50 Å–200 Å.

Figure 3:
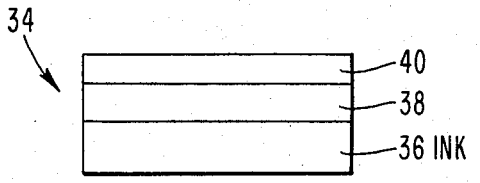
FIG. 3 shows another alternative embodiment for a resistive ribbon in accordance with the present invention, where the conductive current return layer is omitted.

FIG. 3 shows an alternative ribbon arrangement 34 which is comprised of a fusible ink-bearing layer 36, a support layer 38, and a resistive layer 40. The thin, highly conductive metal layer 28 and the interface layer 30 of ribbon 22 are not present in ribbon 24.

The compositions of the layers 36–40 and their thicknesses are preferrably in the ranges described previously for the functionally equivalent layers of ribbon 10.

Figure 4:
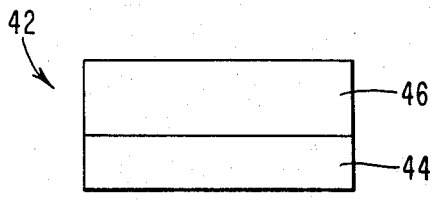
FIG. 4 shows another alternative embodiment for a resistive ribbon in accordance with the present invention, where the resistive layer is sufficiently thick to provide a support function, thereby eliminating the need for a separate support layer.

In FIG. 4, the ribbon 42 is comprised of only two layers 44 and 46. In this embodiment, the ink-bearing layer 44 is supported by the resistive layer 46, which is made thicker so that it can also provide the support function. This eliminates the need for a separate support layer. While the conductive layer providing a current return path is not shown in FIG. 4, it will be understood by those of skill in the art that such a layer could also be included, as could be the interface layer 30 shown in FIG. 2. The thickness of resistive layer 46 is chosen to be such that it will provide the necessary support function. Since its composition is different from that of the usual polymeric binder support layers, the thickness range when the resistive layer 46 is used as a support layer is often different from that when a separate support layer is used. A representative range of thicknesses for resistive layer 46 is 2.5–25 micrometers.

In FIGS. 2–4, the receiving medium is not shown, although it will be apparent to those of skill in the art that the ribbons 22, 34, and 42 of FIGS. 2–4 are used in the same manner as the ribbon 10 of FIG. 1.

(Typical Operations Characteristics and Compositions-FIGS. 5–9)

FIGS. 5–9 illustrate some of the compositions which can be provided for suitable resistive layer compositions, and the current-voltage characteristics which are obtained. While these curves are for some representative systems, it will be understood that similar curves can be developed for all classes of metal-wide bandgap insulator compositions in accordance with the present invention. In the practice of this invention, a practitioner would fabricate various compositions in order to test the relative proportions of metal and insulator to be used to give the desired resistivity for any particular application. The practitioner would also plot current-voltnage characteristics to examine the power required for these different compositions in order to match the ribbon to a suitable power supply.

Figure 5:
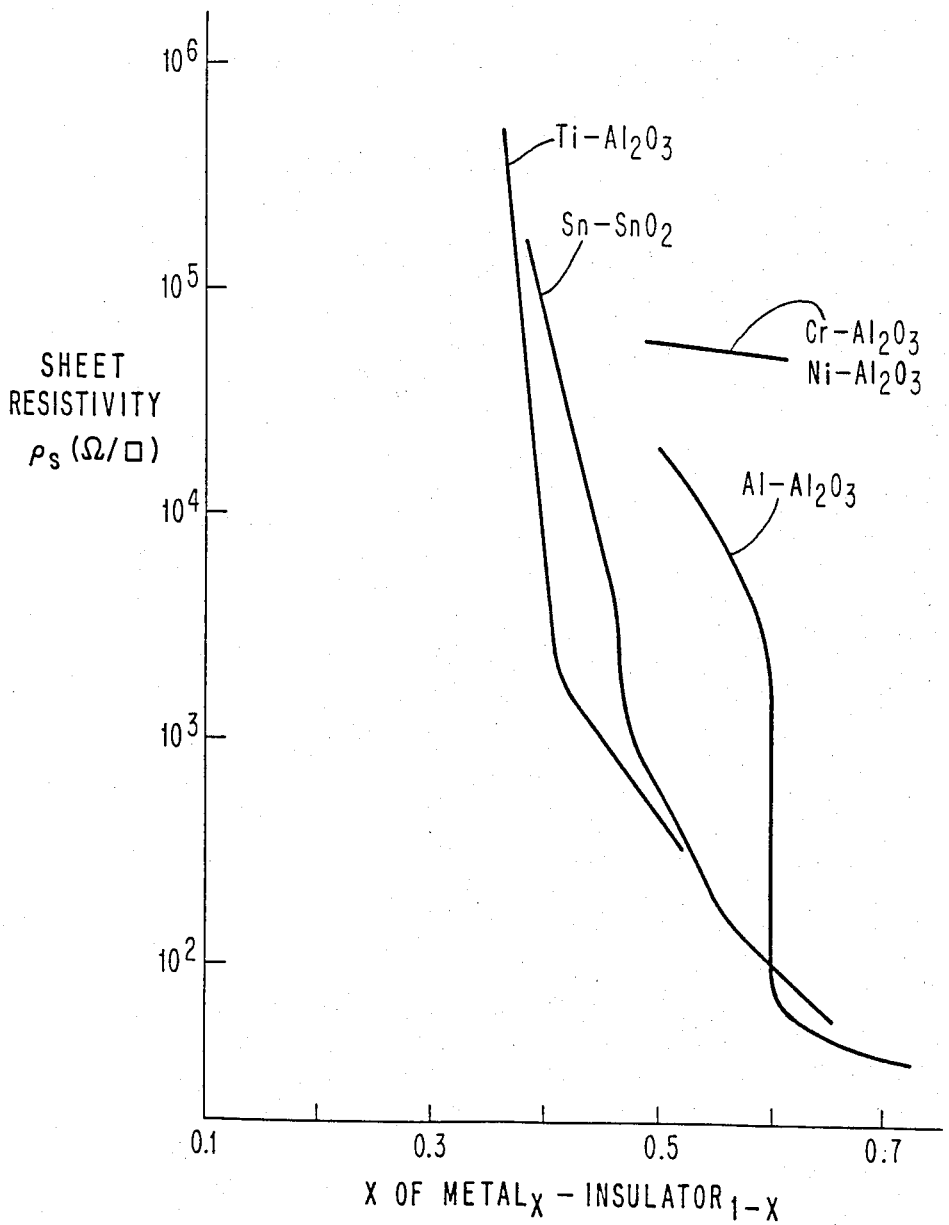
FIG. 5 is a plot of sheet resistivity $\rho_s$ as a function of composition for different metal-insulator resistive layers, indicating the various ranges of sheet restivity which can be obtained by varying the compositions of these metal-insulator resistors.

In FIG. 5, the sheet resistivity $\rho_s$ in ohm/sq. is plotted against the subscript x in the composition $metal_x$-$insulator_{1-x}$. Different curves are shown for different materials, representing the different amounts of resistivity that can be obtained with different values of x. In this FIG., a dual electron beam evaporation system was used to evaporate from a metal source and from an insulator source to the ribbon substrate. However, for the curve designated Sn-$SnO_2$, single source evaporation was used in which Sn was evaporated in an oxygen atmosphere. Measurement of the resistivity was made with a microprobe.

The curves show the resistivity that is obtained as the mole fraction x of metal-insulator is changed. In a desirable system, it is advantageous that the resistivity be invariant over the relatively large range of x. The region of interest in resistivity in the printing system described previously is typically 100–1000 ohms per square. Thus, the curves having a more horizontal slope in this resistivity range are more favorable. Consequently, the most favorable materials from this plot are the curves for Ti-$Al_2O_3$ and Sn-$SnO_2$. The curves for Cr-$Al_2O_3$ and Ni-$Al_2O_3$ produce too high a sheet resistivity for the values of x which are shown. This does not mean that these materials cannot be used for printing; however, they will require higher voltages.

On the other hand, the Al-$Al_2O_3$ curve is very vertical in the resistivity range 100–1000 ohm/sq. This means that the tolerance on x must be very tight, which is more difficult during fabrication.

Another way to vary the resistivity of the film is to vary the pressure of the gaseous environment in the evaporation or sputtering chamber. This will affect the relative amounts of metal and insulator in the resistive layer. This parameter (change in gas pressure) can be combined with a change in evaporation rate in order to get even different compositions. For example, in the $Al-Al_2O_3$ system, it was found that, at higher rates of evaporation, more oxygen pressure was required in order to obtain higher resistivities. Those of skill in the art will appreciate that this is a logical result, since higher evaporation rates mean that greater amounts of Al atoms are being evaporated (or sputtered) from the Al source. To obtain a larger percentage of the oxide $Al_2O_3$, higher oxygen pressures are required.

Figure 6:
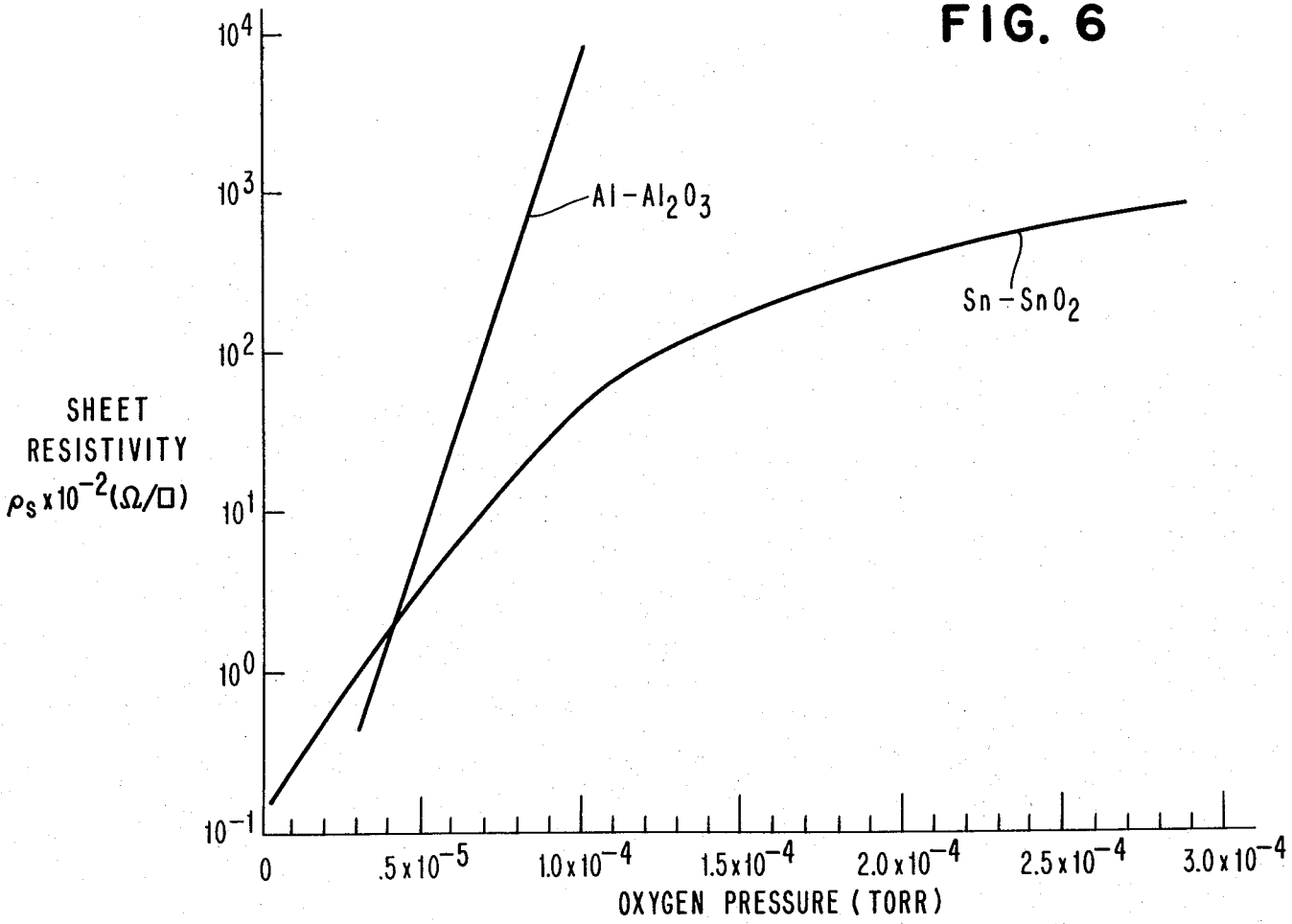
FIG. 6 is a plot of sheet restivity $\rho_s$ versus oxygen pressure for two different metal-insulator resistive layer compositions, indicating the different restivities which can be obtained as a function of oxygen pressure during deposition of the resistive layer.

FIG. 6 is a plot of sheet resistivity $\rho_s$ times $10^{-2}$ (ohm/sq.) as a function of oxygen pressure (torr). Curves for $Al-Al_2O_3$ and $Sn-SnO_2$ are shown. From these curves, it is apparent that the change in oxygen pressure has a lesser influence on the resistivity of the $Sn-SnO_2$ layer than it does on the $Al-Al_2O_3$ layer. For this reason, $Sn-SnO_2$ mixtures may be preferred from a fabrication viewpoint, particularly in those applications where it is desired to have a resistivity between 100 and 1000 ohms/sq.

Figure 7:
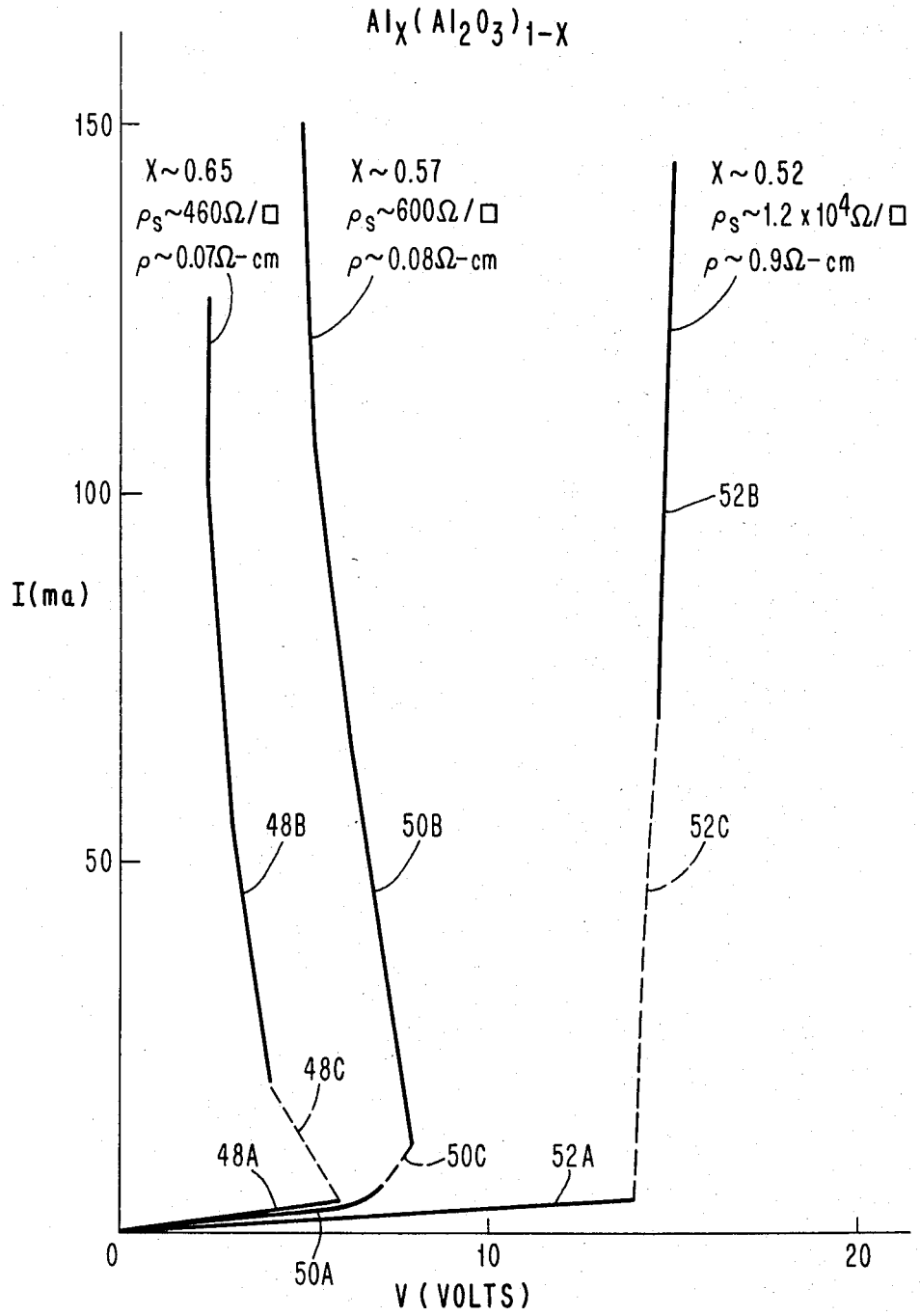
FIG. 7 is a plot of current versus voltage for three different compositions of resistive layers comprising $Al_x(Al_2O_3)_{1-x}$, indicating the impedance switching characteristics of these three compositions.

FIG. 7 is a plot of current-voltage for a resistive layer 20 comprised of $Al_x(Al_2O_3)1-x$, for three different values of the mole fraction x. Each of these curves is comprised of a high resistance state and a low resistance state, where the films exhibit switching from a high impedance state to a low impedance state. These current-voltage curves were obtained from a four layer ribbon of the type shown in FIG. 1, comprised of a support layer 16, an ink-bearing layer 12, a conductive layer 18, and a resistive layer 20. The resistivity $\rho_s$ of each of the different compositions is the resistivity of the film when deposited, as measured by a four point probe.

The curve for x=0.65 is comprised of a high impedance portion 48A and a low impedance portion 48B. The dashed line 48C represents the switching behavior when the resistive layer 20 switches from its high impedance state 48A to its low impedance state 48B. For this resistive layer 20, this switching behavior occurs when the voltage increases to about 6 volts. The amount of time the resistive layer spends in the high impedance state is extremely small, and the actual melting and transfer of ink to the receiving medium occurs when the resistive layer is in its low impedance state 48B. This state is characterized by a "holding" voltage, which is the average voltage associated with this low impedance state. This is the voltage at which printing occurs, and it is desirable to have this voltage as high as possible, so as to bring the current level to that which can be provided by the power supply. In the resistive compositios of this invention, this "holding" voltage is in excess of two volts, and is typically several times that amount.

For the curve with x approximately 0.57, a high impedance region 50A exists, as well as a low impedance region 50B. The switching characteristic between these regions is indicated by the dashed curve 50C. As is apparent, the holding voltage for this composition is higher than for the composition with x approximately 0.65. This second composition provides more favorable characteristics in the system described previously.

The third curve in FIG. 7 shows the switching characteristic of a composition where x is approximately 0.52. It is comprised of a high resistance portion 52A and a low resistance portion 52B. Switching between these resistance states is indicated by the dashed curve 52C. For this composition, switching to a low impedance state does not occur until approximately 14 volts.

The only requirement for printing is that there be sufficient power to melt and transfer the ink. Impedance switching is not needed and can be disadvantageous. However, in those situations where switching does occur, it is desirable to have a high holding voltage to minimize the current requirement for printing. It is also desirable that the switching voltage not be so high as to exceed the voltage which can be delivered by the power supply that is used. For example, if a power supply will provide 30 volts maximum and a resistive layer will not switch impedance to a low impedance state at a voltage less than that, all printing would have to be done in the high impedance state, which would be disadvantageous. The resistive layers of this invention provide these desired features in those ribbons where switching occurs.

As mentioned previously, an interface layer of the type illustrated by layer 30 in FIG. 2 can be used in combination with a resistive layer 32 to adjust the switching and holding voltages. By using different thicknesses for the interface layer 30, the low impedance state can be shifted to the right in FIG. 7 in order to provide higher holding voltages. A table will be shown later illustrating the effect of the insulator interface layer 30 on the holding voltage.

Figure 8:
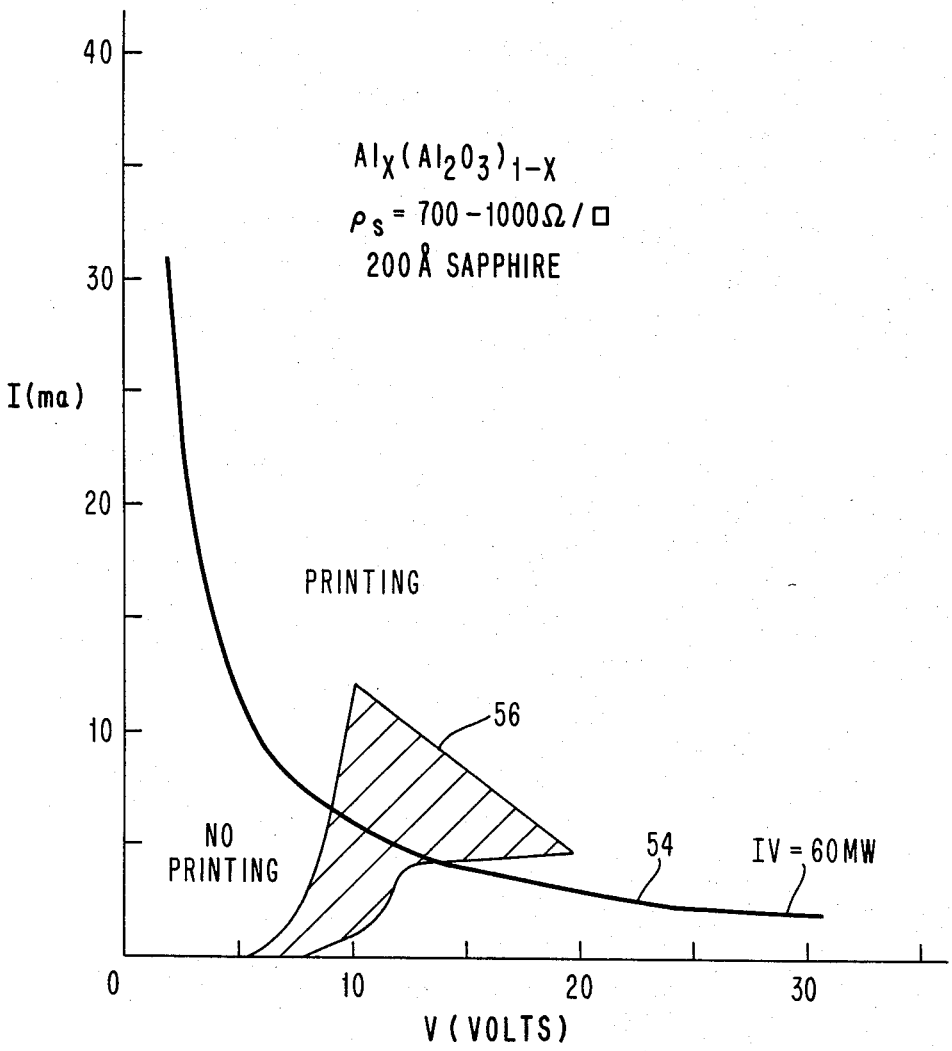
FIG. 8 is a plot of current versus voltage for a resistive layer comprised of $Al_x(Al_2O_3)_{1-x}$, in the resistive ribbon of FIG. 2 including a 200 Å sapphire interface layer, where the cross-hatched area represents the switching characteristics of the resistive layer, indicating the portion of the switching characteristics which is suitable for printing in this particular system.

FIG. 8 is a current versus voltage plot of an actual printing system using a ribbon 22 of the type shown in FIG. 2. This ribbon 22 included a resistive layer 32 and a 200 Å thick insulator interface layer 30 (which in this ribbon 22 was sapphire). The sheet resistivity of the resistive layer 32-interface layer 30 combination was 700–1000 ohms/sq. over the composition range of the $Al_x(Al_2O_3)_{-x}$ resistive layer. Curve 54 is a constant power curve representing a product of current and voltage, and in this drawing is 60 mW. For this ribbon 22, no printing will occur until the applied power level reaches 60 mW. Thus, the region above curve 54 is the region in which printing will occur, while the region below curve 54 is the region in which printing will not occur. It is therefore desirable to provide a resistive layer 32 having current-voltage characteristics such that sufficient power (i.e., >60 mW) is available for printing.

In FIG. 8, the cross-hatched region 56 represents a broad band of switching characteristics of this $Al-Al_2O_3$ composition. Average switching characteristics are shown, and for this reason a broad band 56 is drawn. From this plot, it is apparent that a good portion of region 56 is above curve 54 and therefore printing will be accomplished. Thus, with $Al-Al_2O_3$ resistive layer compositions providing sheet resistivities in the range of 700–1000 ohms/sq., printing can be obtained using the aforementioned power supply and the ribbon 22 of FIG. 2.

Figure 9:
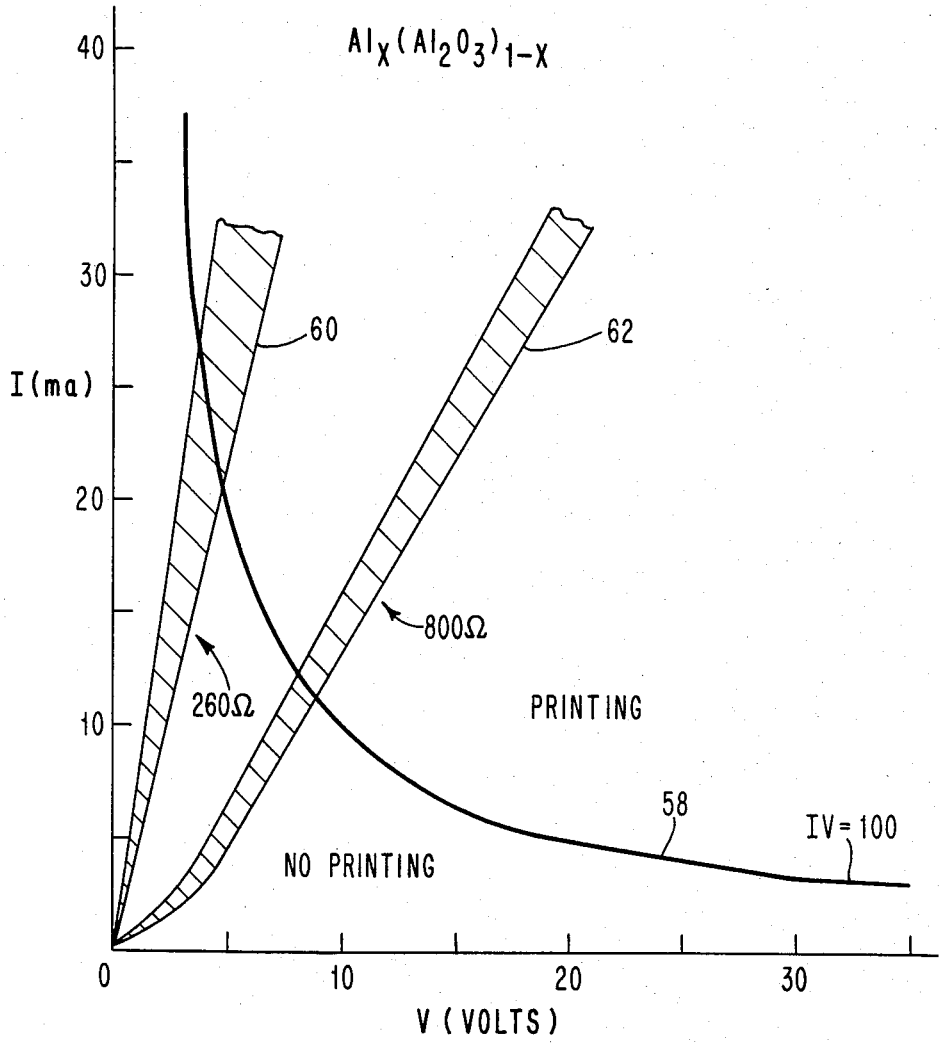
FIG. 9 is a current versus voltage plot for the resistive ribbon of FIG. 3 (no highly conductive current return layer) where the resistive layer is comprised of an $Al_x(Al_2O_3)_{1-x}$ composition, and the cross-hatched regions illustrate current-voltage characteristics for two such resistive layers, each of which has a different resistivity.

FIG. 9 is another current versus voltage plot for a different printing system, where a constant power curve 58 of IV=100 mW is shown. In this system, the resistive ribbon 34 of FIG. 3 was used comprising an ink bearing layer 36, a support layer 38, and a resistive layer 40. A highly conductive underlayer and an interface layer were not used. The resistive layer 40 was comprised of $Al_x(Al_2O_3)_{1-x}$, where the values were chosen to provide two different sheet resistivities. In the first composition the sheet resistivity was 120 ohms/sq., while the second composition had a resistivity of 770 ohms/sq. The current-voltage characteristic of the first composition is represented by the cross-hatched area 60, while the current-voltage characteristic of the second composition is represented by the cross-hatched area 62. As is apparent from this FIG., the second composition provides a wider range of values of current and voltage suitable for printing. The first composition has a resistivity which is too low, and for this reason, the current has to be increased significantly in order to provide a switching characteristic above the constant power curve 58.

The power required to print with the ribbon 34 in FIG. 3 is greater than that required with tne ribbons 10 and 22 of either FIG. 1 or FIG. 2. The reason for this is that no highly conductive layer is provided in the ribbon 34 of FIG. 3, and some heat is dissipated in non-printing areas. Therefore, more power must be applied to cause printing.

When the conductive layer is not present, the contacts of the stylus and broad ground electrode to the ribbon 34 are mote critical and must be closer together to avoid loosing too much power in non-printing areas. Approximately 40% more power is required without the highly conductive layer (layer 18 in FIG. 1 and layer 28 in FIG. 2).

It has been found that resistive ribbons 10, 22 using a conductive underlayer 18, 28, respectively, such as those shown in FIGS. 1 and 2, exhibit more impedence state switching than ribbons such as 34 and 42 which do not have the highly conductive layer. The reason for this is that the electric field is larger across the resistive layer 20, 32 in a ribbon 10, 22, respectively having a highly conductive underlayer. The impedence switching characteristics of a resistive layer 18, 28 are largely dependent upon the electric field across the layer, and for this reason impedence switching is more pronounced when the the ribbons 10, 22 include the highly conductive underlayer 18, 28. However, while the resistive layers 40, 46 are more ohmic without the underlayer 18, 28, more energy is lost through increased current travel in the resistive layers 40, 46. This means that the tolerances on the resistive layers 40, 46 (thickness and compositional uniformity) are more strict.

The following table gives the effects of various parameters on the printing characteristics that have been observed in tests using the ribbons 10, 22, 34, 42 of the present invention and conventional power supplies. Here $V_{knee}$ is the voltage associated with the low impedance state of the resistive layer 20, 32, 40, 46. The interface layer 30, when present, can be any insulator (such as sapphire). The type of printing voltage is illustrated, as is the center (ctr.) of the voltage pulse. As described previously, a holding voltage in excess of three volts is required in this invention. Therefore, the desirable systems in this table are those having resistivities $\rho_s$ of 700–1000 ohms/sq. These compositions were typically Al-$Al_2O_3$. The systems described by the last two rows of this table were obtained using the ribbons 34 of FIG. 3.

EFFECT OF VARIOUS PARAMETERS ON PRINTING CHARACTERISTICS

| $\rho_s$(Ω/Sq.) | Interface layer thickness (Å) | $V_{knee}$ (volts) | Printing Current (mA) | Printing Voltage |
|---|---|---|---|---|
| 700–1000 | 0 | 5–6 | 14 | Spikes 1–3.5v Ctr. 1.5v |
| | 50 | 5–6 | 14 | Spikes 1–4v Ctr. 1.5v |
| | 100 | 9–12 | 12 | Spikes 1–6v Ctr. 2v |
| | 200 | 8–12 | 12 | Spikes 1–9v Ctr. 4v |
| 120 | 50 | 1–2 | 30 | Spikes 2–3v |
| | 100 | 1–3 | 24 | Spikes 2–3v |
| 770 | — | ohmic | 12 | 8 |
| 120 | — | ohmic | 20 | 4 |

In summary, this invention is primarily directed to new types of resistive ribbons and structures for resistive ribbon thermal printing, where the resistive layers are comprised of a metal and a wide bandgap insulator. The metal is used to make the insulator more conducting and any metal which serves this purpose is suitable. The bandgap of the insulator must be at least three volts. Many advantages are provided by using these resistive layers, and they can be used in all types of resistive ribbons. Additionally, because the resistance of these layers can be tailored over wide ranges, they can be used in different types of printing applications, and with constant current or constant voltage power supplies. These thinner ribbons permit more printing area for each ribbon spool.

While the invention has been described with particular embodiments thereof, it will be appreciated by those of skill in the art that many variations can be made without departing from the spirit and scope of the present invention. For example, other metal/insulator combinations can be obtained which will be suitable for resistive layers in resistive ribbon printing. Still further, the number of components in the metal-insulator composition can be more than just two. For example, a plurality of metals can be used with one or more insulators, although to do so would make a more complicated system which is more difficult to fabricate. It is typically desirable to minimize the number of components in the composition so as to improve reliability with respect to thickness and compositional uniformity.

Having thus described our invention, what we claim as new and desire to secure by Letters Patent is:

1. A resistive ribbon for thermal transfer printing, comprising at least a resistive layer and a fusible ink-bearing layer, where electrical current through said resistive layer causes localized heating of said fusible ink, said resistive layer being comprised of a metal-insulator composition where said insulator has a bandgap of at least three volts, the relative amounts of said metal and said insulator in said resistive layer being chosen to provide a desired resistivity.

2. The ribbon of claim 1, where said metal is selected from the group consisting of Ti, Ni, Cr, Mo, W, Cu, Au, Co, Sn, Al, Ta, Mg, and In, and said insulator is selected from the group consisting of $Al_2O_3$, SiO, $SiO_2$, TiO, $TiO_2$, MgO, $Cr_2O_3$, $SnO_2$, $In_2O_3$, AlN, $Ta_2O_5$, and $Ge_3N_4$.

3. The ribbon of claim 1, where said resistive layer has a current-voltage characteristic exhibiting high and low resistance states and switching therebetween, said low resistance state exhibiting a holding voltage associated therewith which exceeds two volts.

4. The ribbon of claim 1, where said resistive layer composition is an amorphous composition.

5. The ribbon of claim 1, where said resistive layer composition is a cermet.

6. The ribbon of claim 1, where said resistive layer composition includes microcrystalline portions.

7. The ribbon of claim 1, where the composition of said resistive layer is substantially uniform over its length.

8. The ribbon of claim 1, where said resistive layer has a resistivity between about 100 ohm-cms. and 1000 ohm-cms.

9. The ribbon of claim 1, where said resistive layer is comprised of a two component composition.

10. The ribbon of claim 1, further including a thin, highly conductive layer.

11. The ribbon of claim 10, further including an insulator interface layer between said resistive layer and said highly conductive layer.

12. The ribbon of claim 11, where said insulator interface layer is chosen from the group consisting of $Al_2O_3$, SiO, $SiO_2$, TiO, $TiO_2$, MgO, $Cr_2O_3$, $SnO_2$, $In_2O_3$, AlN, $Ta_2O_5$, and $Ge_3N_4$.

13. The ribbon of claim 1, further including a support layer located between said resistive layer and said ink-bearing layer.

14. The ribbon of claim 1, where said metal is also present in said insulator.

15. A structure for thermal transfer printing in which heat is produced by current passing through a resistive layer to melt a fusible ink in an ink-bearing layer, said structure including at least a resistive layer comprised of a composition including a metal and an insulator, said insulator having a wide bandgap at least as great as three volts and said metal being present in said composition to provide an electrical conductivity in said composition, the proportions of said metal and said insulator in said composition being chosen to yield a resistivity of said composition between about 100 ohm-cms. and 1000 ohm-cms.

16. The structure of claim 15, where said resistive layer has a thickness between about 0.1 and 2 micrometers.

17. The structure of claim 15, where said resistive layer has a thickness greater than 2 micrometers.

18. The structure of claim 15, where said composition is a cermet.

19. The structure of claim 15, where said resistive layer has substantially uniform composition along its length.

20. The structure of claim 19, where said composition includes two components.

21. The structure of claim 20, where said composition is an amorphous composition.

22. The structure of claim 21, where said metal is selected from the group consisting of Ti, Ni, Cr, Mo, W, Cu, Au, Co, Sn, Al, Ta, Mg, and In, and said insulator is selected from the group consisting of $Al_2O_3$, SiO, $SiO_2$, TiO, $TiO_2$, MgO, $Cr_2O_3$, $SnO_2$, $In_2O_3$, AlN, $Ta_2O_5$ and $Ge_3N_4$.

23. The structure of claim 21, where said resistive layer has a current-voltage characteristic exhibiting high and low resistance states and switching therebetween, said low resistance state exhibiting a holding voltage associated therewith which exceeds two volts.

24. The structure of claim 21, where the resistivity of said resistive layer is between 500 and about 2000 ohms/sq.

* * * * *